United States Patent [19]

Chambers

[11] 4,249,487

[45] Feb. 10, 1981

[54] ROTARY INTERNAL COMBUSTION ENGINE

[75] Inventor: Robert B. Chambers, Boise, Id.

[73] Assignee: Power-D, Inc., Longmont, Colo.

[21] Appl. No.: 34,274

[22] Filed: Apr. 27, 1979

[51] Int. Cl.[3] ..... F02B 57/00

[52] U.S. Cl. ..... 123/44 C

[58] Field of Search ..... 123/44 C

[56] References Cited

U.S. PATENT DOCUMENTS

| | | | |
|---|---|---|---|
| 2,683,422 | 7/1954 | Richards | 123/44 R X |
| 3,921,601 | 11/1975 | Maoz | 123/44 C X |

*Primary Examiner*—Charles E. Phillips

*Attorney, Agent, or Firm*—Hill, Van Santen, Steadman, Chiara & Simpson

[57] ABSTRACT

A rotary internal combustion engine is provided with a central housing having a plurality of cylinders radially disposed around the housing. The cylinders are disposed about the housing such that reciprocal movement of pistons inside of the cylinders results from rotational movement of the central housing about a stationary center axis, so that the pistons are not brought to an instantaneous stop at a point in their cycle at which a 180° change in direction occurs. By not having to overcome such inertial forces, a substantial increase in energy output is achieved. The rotating housing is mounted on supports to stabilize the engine and transmit rotational movement to a driven device. The exhaust output of the individual cylinders is directed outwardly to provide additional torque in the form of a jet action.

8 Claims, 6 Drawing Figures

FIG. 4
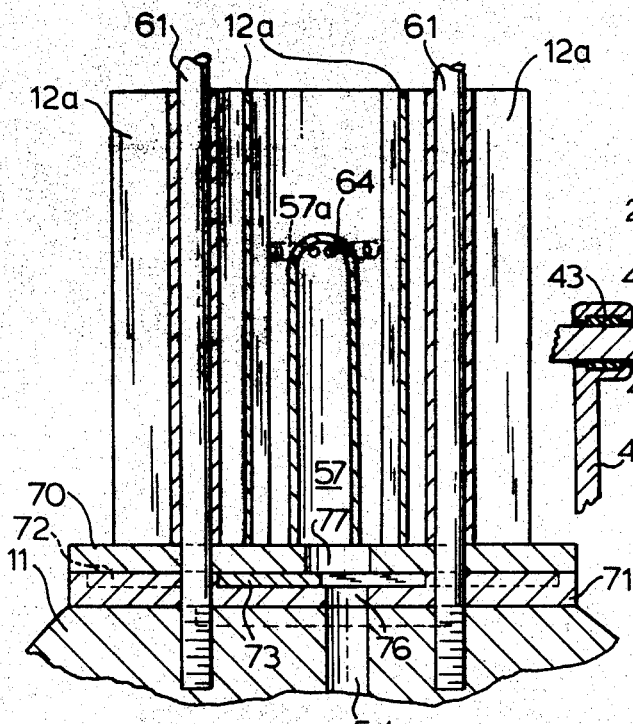
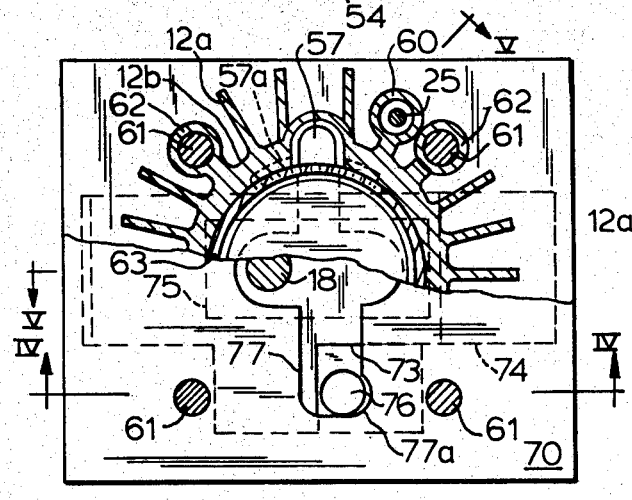
FIG. 3
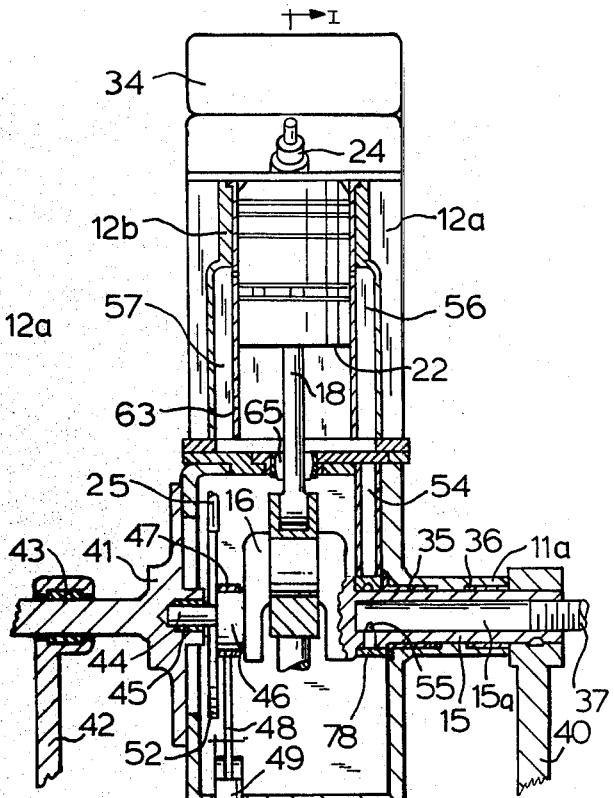
FIG. 2
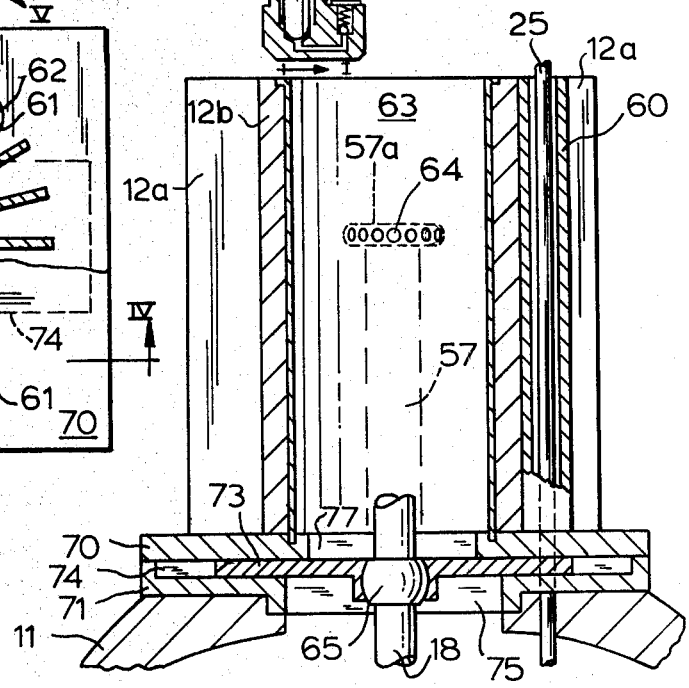
FIG. 5

ROTARY INTERNAL COMBUSTION ENGINE

BACKGROUND OF THE INVENTION

1. Field of the Invention

The present invention relates to rotary internal combustion engines, and more particularly to such engines having a rotating central housing.

2. Description of the Prior Art

Rotary internal combustion engines utilizing conventional piston-cylinder movement are well known in the art. Such engines have a plurality of cylinders radially arranged around a central housing and a reciprocating piston moving inside each cylinder. The pistons are moved by connecting rods attached to a conventional crack shaft.

In such engines, as well as in conventional engines have a V-arrangement of cylinders, each of the pistons comes to an instantaneous stop at a top and bottom of its stroke, at which point its direction of movement is reversed 180°. A substantial amount of energy is thus lost in overcoming the inertial forces in bringing the piston to a halt, and beginning piston movement in an opposite direction.

SUMMARY OF THE INVENTION

In accordance with the principles of the present invention a rotary internal combustion engine has a plurality of cylinders radially disposed around a central housing. The cylinders are disposed such that reciprocal movement of pistons with respect to the cylinders is achieved by rotation of the entire housing-cylinder combination, about a stationary central shaft so that the pistons inside the cylinders do not themselves exhibit reciprocal movement. The twice-occurring 180° change in piston movement occurring in conventinal internal combustion engines is thus eliminated, along with the associated substantial energy loss needed to overcome inertial forces associated with conventional piston movement.

A fuel-air mixture is drawn through a channel in the cylinder wall by the partial vacuum created by the movement of the piston with respect to the cylinder. The fuel-air mixture is drawn through a port in the base of the cylinder which communicates with a carburetor. The port is opened and closed in proper sequence by the sliding movement of a plate over the port which is connected to a piston connecting rod by a ball-joint for coordinated movement therewith.

The exhaust outlets of each of these cylinders is disposed generally tangentially to the direction of rotation of the engine, so that additional torque is provided by the combined jet action of each of the cylinder exhaust outlets. The entire engine may be covered by a shroud to minimize air resistance and direct the exhaust output.

The rotational movement of the engine also facilitates air-cooling of the cylinders by drawing air through the shroud and around the cylinders, and then expelling the air out of the shroud, and also using the heated air to further exhaust-gas combustion.

It is thus an object of the present invention to provide a rotary internal combustion engine which eliminates 180° changes in direction of piston movement inside cylinders, and thus achieves substantial energy savings.

It is another object of the present invention to provide an internal combustion engine which produces added torque by means of directed jet action of cylinder exhaust outputs.

It is a further object of the present invention to provide a rotary internal combustion engine which is air-cooled by its rotational movement through the ambient atmosphere, by drawing the air through a shroud to surround the cylinders and which is then mixed with exhaust gases to burn pollutants, allowing use with richer fuel mixtures resulting in more complete combustion and lower emission of pollutants.

BRIEF DESCRIPTION OF THE DRAWINGS

FIG. 2 is a sectional view of the engine of FIG. 1 taken along line II—II.

FIG. 3 is a sectional view, partly broken away, of one of the cylinders of the engine of FIG. 1 taken along line III—III.

FIG. 4 is a sectional view of one of the cylinders of the engine of FIG. 1 taken line IV—IV of FIG. 3.

FIG. 5 is another sectional view of one of the cylinders of the engine of FIG. 1 taken along line V—V of FIG. 3.

DESCRIPTION OF THE PREFERRED EMBODIMENTS

Figure 1:
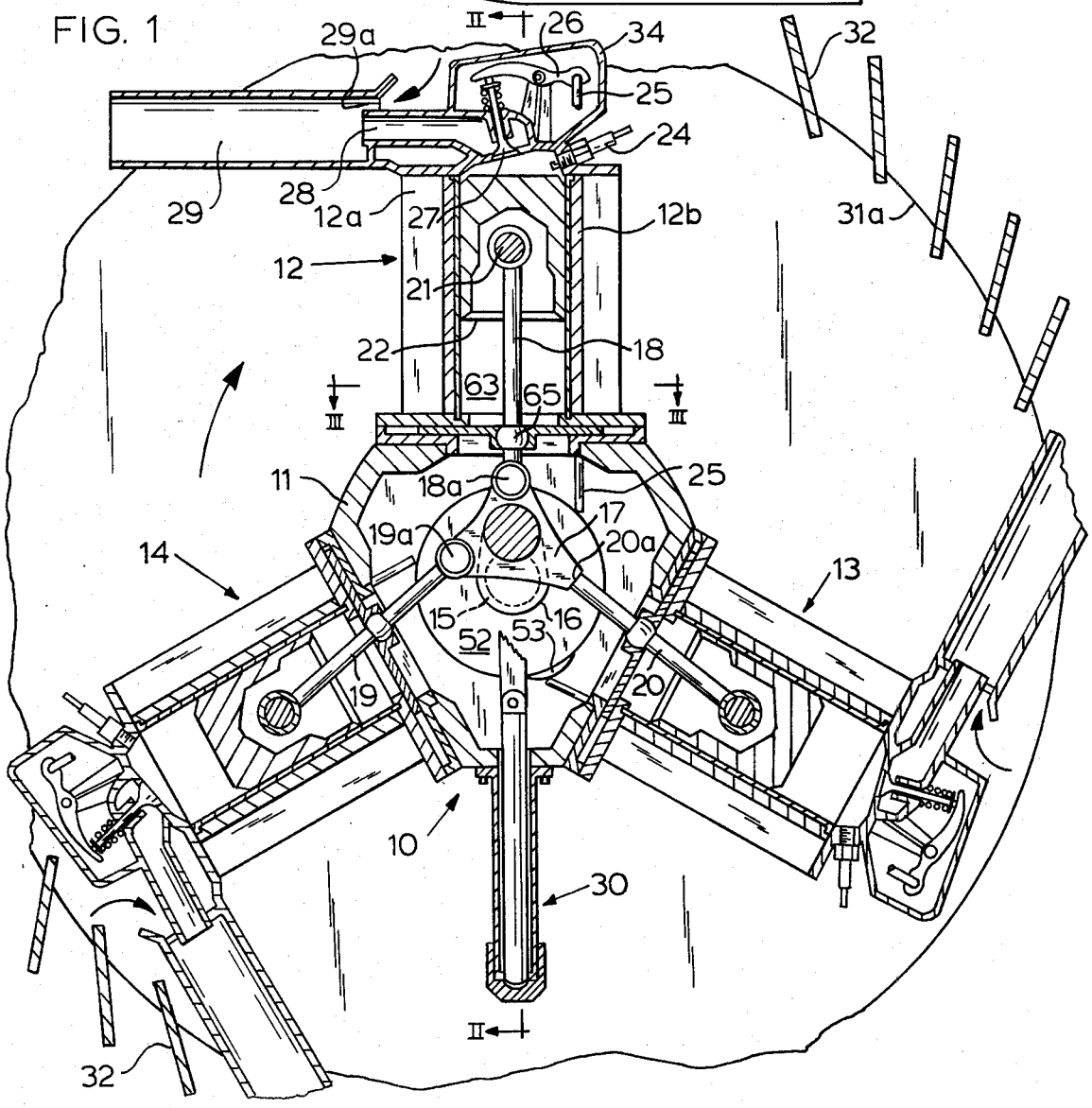
FIG. 1 shows a cross-section side view of a rotary internal combustion engine constructed in accordance with the principles of the present invention.

A rotary internal combustion engine constructed in accordance with the principles of the present invention is shown generally in FIG. 1 at 10. The engine 10 has a central housing 11 with cylinders 12, 13, and 14 radially disposed at equal distance around the housing 11 and attached thereto. Although FIG. 1 illustrates an engine having 3 cylinders, it will be understood that engines utilizing 2, 4, 5, 6, 7 and 8 cylinders can be constructed without departing from the inventive concept disclosed herein.

Each of the cylinders 12, 13 and 14 is of identical construction, and only the cylinder 12 will be described in detail.

A stationary main drive shaft 15 is centrally disposed in the housing 11 and journaled to allow rotation of the housing with respect thereto as described below in greater detail. The drive shaft 15 has an eccentric 16 integrally formed thereon which is rotatably connected to a yoke 17. The yoke 17 is rotatably connected to a piston connecting rod 18 at **18*a* and is similarly connected at 19*a* to another piston connecting rod 19. The yoke 17 is rigidly attached to a third piston connecting rod 20 and 20*a*. As more fully described below, this arrangement of attaching the connecting rods 18, 19 and 20 to the yoke 17** eliminates the instantaneous stopping and direction change required of conventional piston-cylinder arrangement during the course of a power cycle.

A circular plate 52 is rigidly attached to the drive shaft 15 and has a cam 53 mounted on the outer rim thereof which is aligned to engage a lifting rod 25 during a portion of the rotation of the housing 11. The camming action of the cam 53 pushes the lifting rod 25 upwards to move a conventional rocker arm 26 to open a conventional spring-biased exhaust valve 27 at an appropriate portion of the cycle. Opening of the valve 27 connects the interior of the cylinder 12 with an exhaust chamber 28 which is connected to an exhaust outlet or nozzle 29 for removal of exhaust gases. The exhaust outlet 29 has an additional inlet port 29*a* which, upon rotation of the engine 10, acts as a venturi to draw outside air into the exhaust outlet 29 to mix with the exhaust gases. The rocker arm 26 and the valve 27 are contained in a cover 34. The cylinder 12 consists of a cylinder wall 12*b* surrounded by a plurality of radially extending cooling fins 12*a*. A sleeve 63 having apertures 64 therein is fitted inside the cylinder wall 12*b* to form the interior surface of the cylinder 12. A conventional piston 22 moves inside of the cylinder 12 and is pivotally connected to the rod 18 at 21. Lubrication is supplied by conventional means.

As shown in FIG. 2, the housing 11 has an extension 11*a* which engages a support 40 and is journaled for rotation with respect thereto. An end plate 41 is attached to an opposite side of the housing 11 and is supported by a supporting member 42 having a bearing 43 to allow rotation.

The end of the main shaft 15 extends into the plate 41 at 44, and has a bearing 45 to allow rotation of the plate 41 with respect thereto. The main shaft 15 also has bearings 35 and 36 in the housing extension 11*a* so that the entire housing 11 may rotate about the main shaft 15.

As also shown in FIG. 2, the main shaft 15 has another eccentric 46 thereon which is surrounded by a ring 47 pivotally attached to a rod 48 which is turn connected to a plunger 49 of a pump 30. The plunger 49 extends into a well 50 of the pump 30 and is oscillated therein by the action of the eccentric 46. Excess oil accumulating in the housing 11 is thus drawn into the pump 30 and expelled at 51 for re-circulation.

The output of a carburetor or other fuel mixer is connected at 37 to a hollow interior 15*a* of the drive shaft 15. An plurality of radial orifices 55 in the drive shaft 15 connect the interior 15*a* of the drive shaft 15 with a tube 54 assoicated with each cylinder which terminates in a channeled housing 78 surrounding the orifices 55.

The tube 54 is aligned with a channel 56 in the cylinder 12. The fuel-air mixture is selectively introduced into the cylinder 12 by the mechanism shown in detail in FIGS. 3, 4 and 5. As shown in those FIGS., a first plate 71 is adjacent an attached to the housing 11. The first plate 71 has a port 76 therein aligned with the tube 54 and the channel 56 allowing communication therebetween. The first plate 71 also has a recess 72 therein for slidably receiving a closely-fitted T-shaped cover plate 73. The first plate 71 has a centrally disposed rectangular cut out portion 75 to allow movement of the rod 18 therein.

As shown in FIG. 5 the cover plate 73 is connected to the rod 18 by a ball joint 65 through which the rod 18 can slide. As the housing 11 and cylinder 12 move with respect to the piston 22 and rod 18, the rod 18 will slide through the ball joint 65 with only a small side-to-side displacement in the plane of the cover plate 73. Movement of the cover plate 73 in association with the rod 18 thus alternately covers and uncovers the port 76.

A second cover plate 70 is disposed parallel to and on top of the first plate 71 and the cover plate 73. The second cover plate 70 has a generally cross-shaped opening 77 therein, one portion thereof being disposed over the port 76. As shown in FIG. 3, the rod 18 can move in the opening 77 without abutting the plate 70. When the port 76 is not covered by the cover plate 73, the tube 54 is in communication through the port 76 and the opening 77 with channels 56 and 57 in the cylinder 12. The channel 57 terminates in a flattened region 57*a* aligned with apertures 64 to allow the fuel-air mix to enter the cylinder 12. The channel 56 terminates in an identical manner.

When the piston 22 is at the inner end of the cylinder 12, the plate 73 is in a central position covering the port 76. As the piston 22 begins to move toward the head of the cylinder 12 the lower end of the rod 18 moves out of alignment with the cylinder axis in a direction opposite the rotational direction of the housing 11. This causes the plate 73 to move in the same direction as the rod 18 uncovering the port 76 drawing a fuel mix into the inner end of the cylinder, and changing the passages 56 and 57 with fuel mix.

As the piston 22 more closely approaches the head of the cylinder 12, the plate 73 is shifted back to the central position, again covering the port 76 and blocking fuel entry into the passages 56 and 57 until the cycle is again repeated. The fuel-air mix is thus trapped beneath the piston 22 at the inner end of the cylinder 12 until the top of the piston 22 moves past the apertures 64. When this occurs, the compressed fuel mixture aided by centrifugal force, is forced through the apertures 64 into the head of the cylinder 12 where it is ignited by a spark plug 24, connected to a conventional automotive electrical system (not shown).

As shown in FIG. 3, the cylinder 12 and the plates 70, 71 and 72 are held in position by bolts 61 extending through receptacles 62 integrally formed on the exterior of the cylinder 12. A similar receptacle 60 provides a channel for receiving the lifting rod 25.

The above-described manner of construction and operation is such that reciprocal movement of the pistons with respect of each of the cylinders occurs only as a result of the rotation of the housing 11 and cylinders attached thereto. This achieved by the attachment of the rods 18, 19 and 20 to the yoke 17 in coordination with the disc position of the cylinders around the housing 11. Because it is the housing and cylinders which are moving, rather than the pistons, the instantaneous stopping of each piston to change movement direction is eliminated. During a complete revolution the distance of the piston from a central pivot point remains substantially constant. Reciprocating action is thus produced without reciprocating motion of the pistons of any significant amount. In conventional internal combustion engines, no matter what cylinder configuration is utilized, a significant amount of energy is lost due to overcoming the inertial forces in the constant change of direction of the pistons inside the cylinders. Because such inertial forces are not present in the engine 10, a significant horsepower output is achieved, through an operating efficiency which it is impossible to achieve with conventional reciprocal piston movement.

Figure 6:
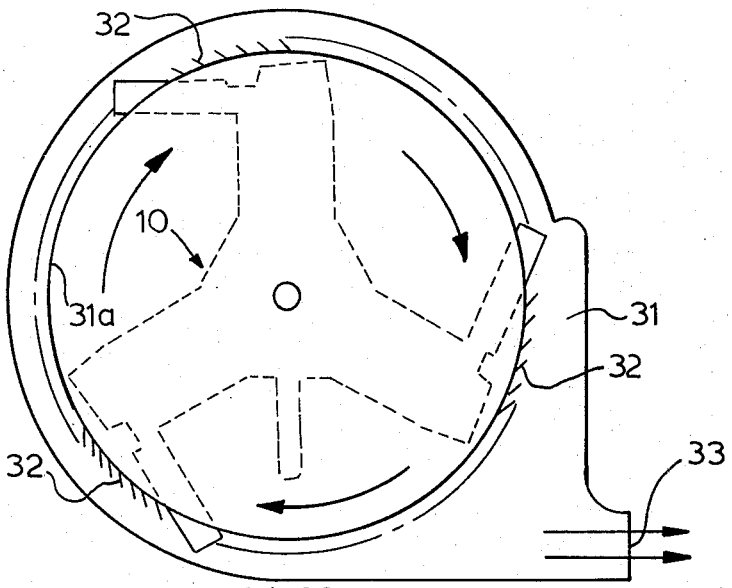
FIG. 6 is a schematic illustration of the engine of FIG. 1 enclosed in an exhaust directing shroud.

As shown in FIGS. 1 and 6, the construction of the engine 10 allows for additional torque to be achieved by directing the flow of exhaust gases from each of the cylinders. The exhaust gases emerging from the exhaust pipe 29 are outwardly directed generally tangentially to the direction of rotation of the engine 10 so as to provide a jet action which adds to the output torque. The entire engine 10 may be housed in a shroud 31 as shown in FIG. 6 to minimize air resistance. The shroud 31 is provided with an output 33 for directing the exhaust gases in a selected direction.

Another advantage of the construction of the engine 10 is that carbon monoxide and hydrocarbon emissions can be minimized. As shown in FIG. 1, the exhaust pipe 29 has a venturi port 29*a* to draw pre-heated air into the exhaust pipe 29 to mix with the exhaust gases therein. The air may enter the shroud near its center and is directed by baffles around the cooling fins 12*a* assoicated with each cylinder to provide air cooling thereof. The heat transfer to the air is such that after cooling the cylinder the air is raised to a temperature which completes combustion of all residue hydrocarbons and carbon monoxide remaining in the exhaust gases. Air movement is aided by blades 32, mounted on an interior wall 31*a* and slanted in a direction opposite the direction of rotation of the engine 10 and shroud 31.

This feature also can result in a decrease in the formation and emission of oxides of nitrogen, which are particularly undersirable pollutants, by allowing the use of a richer fuel mixture. This means the explosion temperature in the cylinder will be well below a critical high temperature which is necessary to produce such oxides.

The elimination of flywheels and counterweights in the above-described invention results in a lightweight, highly efficient engine capable of producing a high torque output.

Although modifications and changes may be suggested by those skilled in the art, it is the intention of the inventor to embody within the patent warranted hereon all such changes and modifications as reasonably and properly come within the scope of his contribution to the art.

I claim as my invention:

1. A rotary internal combustion engine comprising a housing rotatably supported by stationary members, a plurality of cylinders and associated pistons radially disposed around said housing and connected thereto, a centrally disposed stationary shaft supported in said housing to allow rotation thereabout having an eccentrically mounted yoke thereon to which a piston rod for each piston is connected relative to said cylinders such that rotation of said cylinders produces reciprocal movement of said cylinders with respect to said pistons, said shaft having a longitudinal bore therein connected to a fuel mixer and having orifices therein connecting said bore to a tube in said housing terminating in a channelled ring surrounding and communicating with said orifices, said tube being aligned with a fuel entry port in said cylinder, said port alternately covered and uncovered by a sliding plate connected by a ball-joint to a piston rod for lateral reciprocal movement therewith, said port connecting said tube to channels in a cylinder wall which communicate with an interior of said cylinder through a plurality of orifices in said cylinder wall, such that a partial vacuum created by movement of said piston in said cylinder draws fuel through said bore, tube, port and channels into said cylinder.

2. A rotary internal combustion engine comprising a housing rotatably supported by stationary members, a plurality of cylinders and associated pistons radially disposed around said housing in connected thereto, a centrally disposed stationary shaft in said housing about which said housing rotates, said shaft having an eccentrically mounted yoke thereon to which a piston rod for each piston is connected relative to said cylinders such that rotation of said cylinder produces reciprocal movement of said cylinder with respect to said pistons, said shaft having a longitudinal bore therein connected to a fuel mixer and having orifices to connect said bore to a tube in said housing, terminating in a channelled ring surrounding and communicating with said orifices, first, second and third plates disposed between said housing and a bottom of each cylinder, said first plate having one side adjacent said housing and a second opposite side having a centrally disposed T-shaped recess therein and a centrally disposed slot in said recess through with a piston connecting rod extends, said first plate further having a fuel entry port in said recess aligned with said tube, said second plate also having a T-shape and slidably engaged in a cross bar of said recess movable to alternately cover and uncover said fuel entry port, said second plate further having a ball-joint engaging said piston connecting rod for lateral co-movement therewith, said third plate disposed above and adjacent said first and second plates and having a cut out therein having portions thereof aligned with channels in a wall of said cylinder such that when said second plate uncovers said fuel entry port a fuel mix flows through said port, through said cut out and through said channels and reaches an interior of said cylinder through a plurality of orifices aligned with said channel in said cylinder wall.

3. The rotary internal combustion engine of claim 2 wherein said channels in said cylinder wall are formed by a U-shaped groove milled in said wall having an open side which is covered by a sleeve fitted inside said cylinder and forming an interior wall thereof, said sleeve having a plurality of orifices therein aligned with said U-shaped groove to transmit said fuel mix to the interior of said cylinder.

4. The rotary internal combustion engine of claim 2 having an oil evacuating pump attached to said main housing for removal of oil therefrom, said pump having a suction plunger operated by a lever connected to a cam on said shaft producing reciprocal movement of said plunger as said housing rotates about said shaft.

5. The rotary internal combustion engine of claim 2 wherein each of said cylinders has an exhaust pipe for removal of exhaust gases therefrom, said exhaust pipes disposed generally tangentially to a direction of rotation of the housing to provide a jet action of expelled exhaust gases thereby adding to the output torque of said engine.

6. The rotary internal combustion engine of claim 5 wherein each of said exhaust pipes is provided with a venturi inlet passage connecting said exhaust pipe to heated air which has been used to cool said cylinders so that upon rotation of said engine the heated air is mixed with said exhaust gases to facilitate further combustion thereof and thereby decrease emission of pollutants.

7. The rotary internal combustion engine of claim 5 wherein said engine is covered by a shroud for minimizing air resistance during rotation of said engine and which has an outlet port for outwardly directing said exhaust gases to produce a jet action, and an inlet for drawing air for cooling said cylinders into said shroud.

8. The rotary internal combustion engine of claim 7 wherein said shroud is provided with a plurality of fan blades slanted in a direction opposite a direction of rotation of said engine to direct heated air toward a venturi port in each exhaust pipe for mixture with exhaust gases to facilitate further combustion thereof.

* * * * *